United States Patent [19]

Kinoshita et al.

[11] 4,088,873

[45] May 9, 1978

[54] RENTAL TIME CONTROL SYSTEM IN COIN-OPERATED LOCKER

[75] Inventors: Yoshio Kinoshita; Masayuki Iguchi, both of Himeji, Japan

[73] Assignee: Glory Kogyo Kabushiki Kaisha, Japan

[21] Appl. No.: 735,405

[22] Filed: Oct. 26, 1976

[30] Foreign Application Priority Data

Oct. 24, 1975 Japan ..... 50-128676

[51] Int. Cl.[2] ..... G06M 3/02; G07D 9/00

[52] U.S. Cl. ..... 235/92 AC; 194/DIG. 18; 235/92 CN; 235/92 T; 235/92 R

[58] Field of Search ..... 235/92 T, 92 AC, 92 CN, 235/92 CT; 133/8 R; 194/DIG. 16, DIG. 8, 17; 58/145 R, 152 R

[56] References Cited

U.S. PATENT DOCUMENTS

| | | | |
|---|---|---|---|
| 1,148,438 | 7/1915 | Boswell | 235/92 CN |
| 3,641,321 | 2/1972 | Tonne | 235/92 T |
| 3,665,165 | 5/1972 | Strandberg et al. | 235/92 T |
| 3,933,231 | 1/1976 | Vinet | 194/DIG. 18 |

*Primary Examiner*—Joseph M. Thesz

*Attorney, Agent, or Firm*—Wenderoth, Lind & Ponack

[57] ABSTRACT

A coin-operated locker is provided with a rental time control system comprising a time lapse detecting section for counting rental time in such a manner that its counting operation is started when the key turned to lock the locker is pulled out of the lock, and the counting operation is suspended when the key is inserted into the lock before opening the locker. The time lapse detecting section is reset when the key inserted into the lock is turned to open the locker or when the door is opened.

5 Claims, 5 Drawing Figures

RENTAL TIME CONTROL SYSTEM IN COIN-OPERATED LOCKER

BACKGROUND OF THE INVENTION

This invention relates to coin-operated lockers, and more particularly to a rental time control system in a coin-operated locker.

The coin-operated locker serves to keep, for instance, a piece of baggage and charge a rental fee to the user, the fee being dependent on the number of days or hours for which the locker has been used (hereinafter referred to as "rental days" or "rental hours" when applicable). The rental fee can be changed by the operation of a stepping drive means with the aid of signals from a time-lapse detecting section in the locker.

In conventional coin-operated lockers which charge rental fees in accordance with the number of rental days, the change of the rental fee is carried out once a day, that is, at midnight or 00:00 hour. Accordingly, for instance a rental fee charged to a person who uses the locker from 23:00 hours today to 01:00 hour tomorrow is equal to that charged to another person who uses it from 01:00 hours today to 23:00 hours tomorrow. That is, the rental fee charging system of the conventional coin-operated locker is not always reasonable.

In order to overcome the above described difficulty of the conventional coin-operated lockers, a coin-operated locker which will charge a rental fee in accordance with the number of rental hours, that is, an overtime fee charging operating is conducted whenever a predetermined period of time has passed has been prosed.

The present invention relates to an improvement of the coin-operated locker of this type.

SUMMARY OF THE INVENTION

Accordingly, a primary object of this invention is to provide a rental-time control system in a coin-operated locker which will charge according to the number of rental hours, in which when the key is inserted into the lock to take a piece of baggage out of the locker, the rental hour counting operation is suspended.

A further object of the invention is to provide a rental-time control system in a coin-operated locker, in which a rental-time counting circuit is reset in response to the opening of the door of the locker or the operation of the key provided for the lock of the locker.

The foregoing objects and other objects of the invention have been achieved by the provision of a rental time control system in a coin-operated locker, which, according to the invention, comprises a time-lapse detecting section for producing a time lape output signal to charge an overtime fee whenever a predetermined unitary time passes, and a key insertion detecting switch which, upon insertion of the key into the lock of the locker, is operated to provide a stop signal to the time lapse detecting section.

The nature, principle, and utility of the present invention will become more apparent from the following detailed description and the appended claims when read in conjunction with the accompanying drawings, in which like parts are designated by like reference characters.

DETAILED DESCRIPTION OF THE INVENTION

Figure 1:
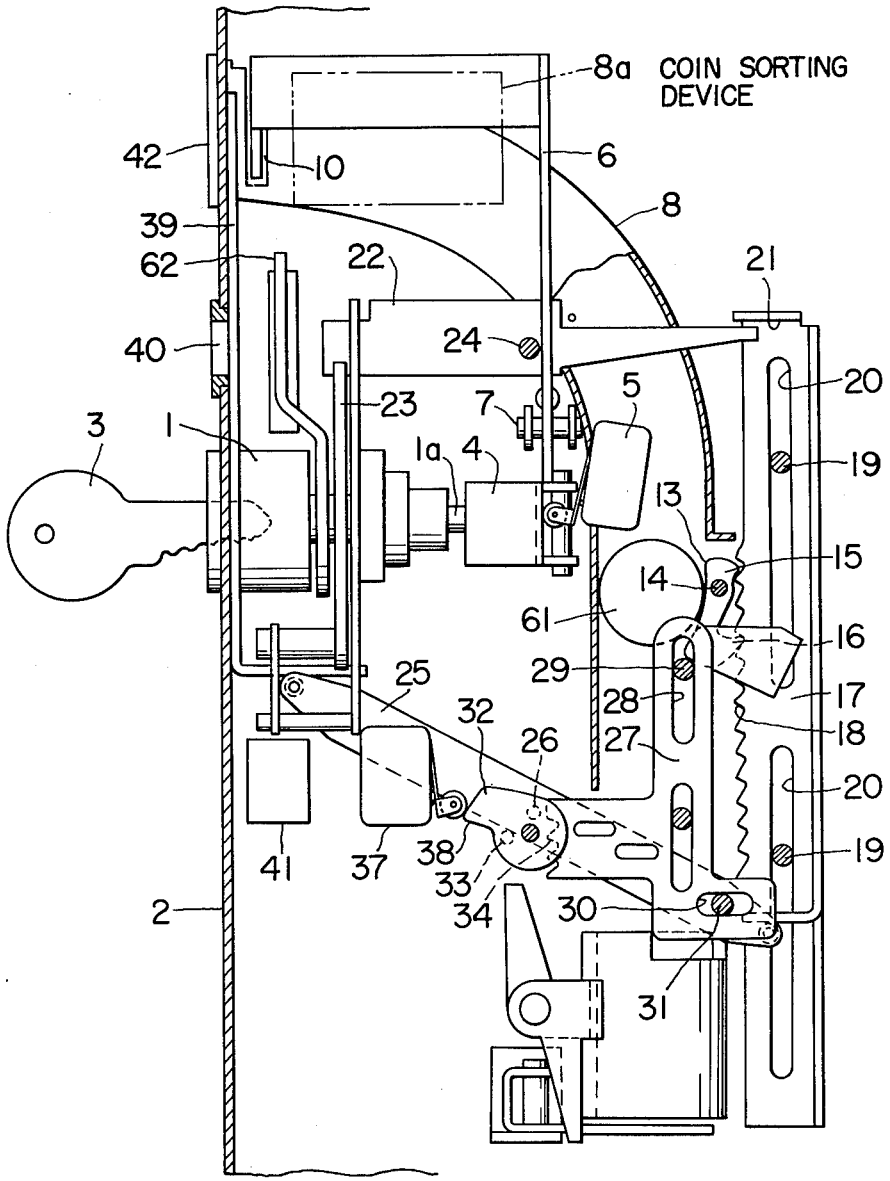
FIG. 1 is a side view, with parts sectioned, illustrating the mechanical arrangement of a coin-operated locker according to this invention.

First, the mechanical arrangement of a coin-operated locker provided with a rental-time control system according to this invention will be described with reference to FIGS. 1 and 2. The locker comprises a cylinder lock 1 mounted on a front panel 2, and a locking lever 62 which is turned by a key 3 to allow the door of the locker to be opened or closed.

Upon insertion of the key into the lock, a cam plate 4 is pushed backward to operate a key insertion detecting switch 5 and a shutter lever 6. More specifically, when the cam plate 4 is moved in the direction of the arrow A (in FIG. 2) by inserting the key 3 into the lock, the shutter lever 6 is turned around a shaft 7 in the direction of the arrow B against the elasticity of a spring 43 connected to the shutter lever 6, and therefore a shutter plate 10 provided on one end of the shutter lever 6 is moved out of a slit 9 provided in a coin path 8 to open a coin inlet 42. This shutter lever 6 may be fixedly held also by excitation of a solenoid 12 in an operation inhibiting means 11 (described later). When the shutter lever 6 is fixedly held, it abuts against the cam plate 4 to prevent the insertion of the key into the cylinder lock 1.

The coin path 8 is communicated with the coin inlet 42 on the front panel 2 and with a coin sorting device **8*a*. In the coin path 8, there is provided an "L"-shaped ratchet lever 13 which is rotatably supported by a shaft 14. The ratchet lever 13 has pawls 15 and 16 which are caused to engage teeth 18 of a rental fee setting plate 17 alternately by displacement of the gravity center of the ratchet lever 13. The rental fee setting plate 17, being guided vertically by pins 19 and elongated slots 20, tends to move downward because of its weight. The plate 17 has an engaging piece 21 at the upper end which as the plate 17 moves downward, engages one end of an engaging lever 22. The engaging lever 22 is rotatably supported by a shaft 24. This engaging lever 22 tends to turn itself counterclockwise because its center of gravity center is off the shaft 24 and thereby to insert its other end into an engaging plate 23 of the cylinder lock 1. Thus, the operation of the cylinder lock 1 is prevented by the engagement of the engaging lever 22 and the engaging plate 23**.

The rental fee setting plate 17 is driven by the swinging motion of a drive lever 25 which is swingably supported by a shaft 26 and is coupled at one end to an overtime fee charging drive plate 27 through an elongated slot 30 and a pin 31. The drive plate 25 moves the overtime fee changing drive plate 27 up and down in a vertical guide direction determined by a pin 29 and an elongated slot 28. The overtime fee charging drive plate 27 is moved upward by the rotation of a synchronous drive cam 32. More specifically, as the drive cam 32 is turned, a pin 33 provided thereon engages a tooth 34 of the overtime fee charging drive plate 27 to move the latter upward. The drive cam 32 is turned by an electric motor 36 in a stepping drive means 35 which will be described latter. The drive cam 32 has a circular cam surface and a projection 38 protruded from the circular cam surface, and is kept abutted against the control lever of a switch 37.

The other end of the drive plate 25 supports the lower end of a display panel 39 against its weight which is adapted to display, through a window 40 in the front panel 2, for instance the period of time which has passed for the use of the locker, the number of coins or an amount of money to be inserted into the coin inlet, and so forth.

The coin-operated locker further comprises a key-turning-operation detecting switch 41 which is operated when the locking lever 62 is turned in the locking direction with the key 3 turned to lock the door of the locker after the door has been closed, and also when the locking lever 62 is turned in the unlocking direction with the key turned to unlock the door. In the case when the key 3 is turned in the unlocking direction, the switch 41 operates as a reset switch for resetting a time-lapse detecting section (described later). The cooperative mechanism between the switch 41 and the locking lever 62 is not shown for simplification.

Figure 3:
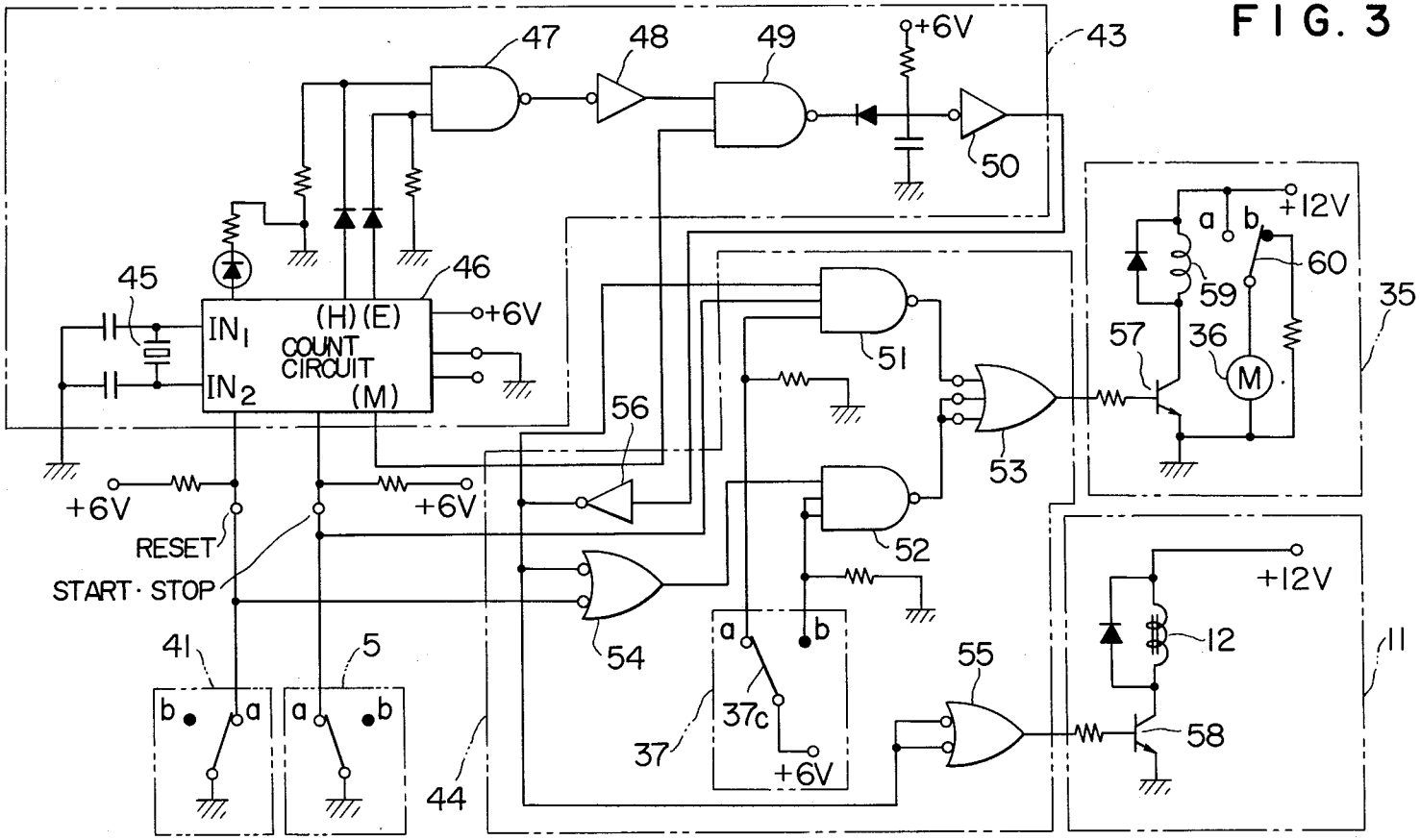
FIG. 3 is a block diagram illustrating an electrical control device for controlling the mechanical arrangement.

Now, an electrical control device for controlling the above-described coin-operated locker will be described. The electrical control device, as shown in FIG. 3, comprises a time lapse detecting section 43, a control section 44, the above-described operation inhibiting means, 11 and stepping drive means 35.

The time lapse detecting section 43 is made up of a quartz oscillator 45, a count circuit 46, NAND circuits 47 and 49, inverter circuits 48 and 50, and other circuit elements. This section 43 operates in response to the operations of the key insertion detecting switch 5 and the key-turning operation detecting switch 41 to produce pulses, or time lapse output signals, at predetermined time intervals.

The control section 44 comprises NAND circuits 51 and 52, NOR circuits 53, 54 and 55, and an inverter circuit 56, and controls the stepping drive means 35 and the operation inhibiting means 11 in response to the key inserting, turning and removing operations and also the output signal from the time lapse detecting section 43.

The stepping drive means 35 comprises a transistor 57, an electric motor 36, and a relay 59 with an armature 60 to successively raise the overtime fee charging drive plate 27 under the control of the control section 44.

The operation inhibiting section 11 comprises a transistor 58 and the above-described solenoid 12 so as to inhibit both the operation of the key and the insertion of a coin according to the relationships between an output of the control section and the operation of the key.

The operation of the rental time control system of the coin-operated locker thus organized will be described.

Figure 2:
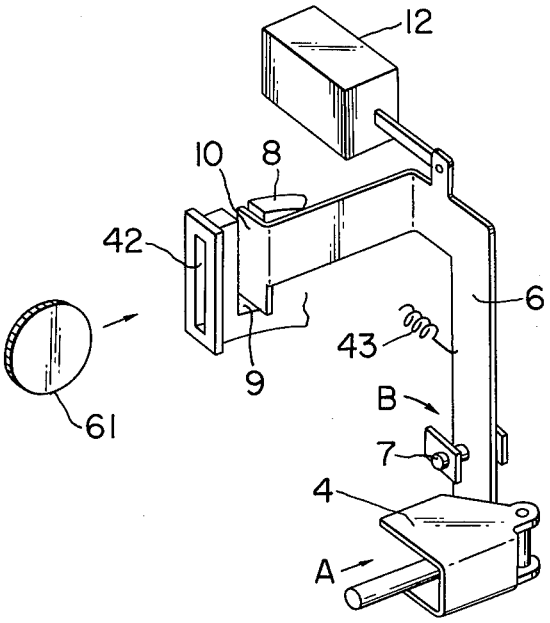
FIG. 2 is a perspective view showing means for blocking the coin inlet of the coin-operated locker.

Before the locker is used, the rental fee setting plate 17 is positioned as shown in FIG. 1, and the coin inlet 42 is open because the key 3 is maintained inserted into the lock. A coin 61 is inserted by a user into the coin inlet. The coin is sorted by the coin sorting device 8*a*, and if it is not acceptable to this locker, it is returned to the user through a coin returning outlet (not shown). If acceptable, it is dropped through the coin path 8, turning the ratchet lever 13 counter-clockwise around the shaft 14. As was described before, the ratchet lever 13 has the pawls 15 and 16 which engage alternately the teeth 18 of the rental fee setting plate 17 so as to allow the latter 17 to move stepwise or one tooth by one tooth. Therefore, the counterclockwise turning operation of the ratchet lever 13 causes the rental fee setting plate 17 to move downward as much as one tooth thereof. As a result of this downward movement, the engaging lever 22 is turned clockwise about the shaft 24, thereby disengaging from the engaging plate 23 to permit the operation of the key 3.

Turning the key 3 inserted into the cylinder lock 1 causes the locking lever 62 to lock the locker, and the armature of the key-turning-operation detecting switch 41 to trip to the contact *b*.

When the key 3 is thereafter removed from the lock 1, the armature of the key insertion detecting switch 5 is tripped to the contact *b*, and the shutter lever 6 is turned around the shaft 7 by the spring 43 to prevent other persons from inserting coins into the coin inlet.

Upon tripping of the armature of the switch 5 to the contact *b*, the count circuit 46 starts time counting operation with an "H" signal employed as its start signal. All of the inputs of the NAND circuit 51 in the control section 44 receive "H" signals, and the NOR circuit 53 connected to the NAND circuit 51 operates to render the transistor 57 of the stepping operation drive means 35 conductive. As a result, the relay 59 is excited to trip its armature 60 to the contact *a* to operate the electric motor M.

Figure 4A:
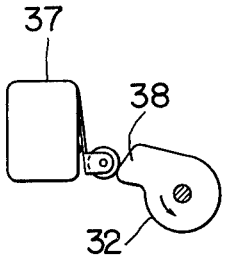
FIGS. 4(A) and 4(B) are explanatory diagrams for a description of the operation of a synchronous drive cam employed in the coin-operated locker.

As the motor M rotates the drive cam 32 kept in the standby state as in FIG. 4(A) begins to turn and finally the armature 37*c* of the switch 37 drops from the projection 38 to the circular surface of the drive cam 32, that is, it is tripped from the contact *a* to the contact *b*. Accordingly, the NAND circuit 51 loses its one "H" input signal, and the motor M is stopped. Thus, the use of the locker starts when the key 3 is removed from the lock.

When a unitary time predetermined for the payment of a predetermined amount of money has been passed, an overtime fee charging operation is carried out as follows.

First, the inverter circuit 50 in the time lapse detecting section 43 produces an "H" signal, for instance, for 5 seconds. This "H" signal is inverted by the inverter circuit 56, and is applied to the NOR circuits 54 and 55. Accordingly, the NOR circuit 54 renders the transistor 58 conductive, and the solenoid 12 connected to the transistor 58 is excited. The coin inlet 42 by the shutter plate 10 is forcibly maintained closed by the solenoid thus excited, and the shutter lever 6 is abutted against the cam plate 4 to prevent the insertion of the key 3. Thus, the operation inhibiting means 11 operates to inhibit the insertions of the key and the coin during the overtime fee charging operation (described later).

On the other hand, the NOR circuit 54 produces an output signal when it receives the output of the time lapse detecting section 43 or the "L" signal of the key turn detecting switch 41. The output signal thus produced renders the transistor 57 conductive through the NAND circuit 52 and the NOR circuit 53. Thus, after the predetermined unitary time, the motor M in the stepping operation drive means 35 is driven, and accordingly the drive cam 32 is turned, so that the pin 33 of the cam 32 engages the tooth 34 of the overtime fee charging drive plate 27 to raise the latter a distance corresponding to one tooth thereof. This upward movement of the overtime fee charging drive plate 27 causes the drive lever 25 to turn counterclockwise to raise the rental fee setting plate 17 a distance corresponding to one tooth thereof. In this operation, the ratchet lever 13 allows this upward movement of the rental fee setting plate, and holds it there. Thus, the overtime fee charging operation is automatically carried out with the rental fee setting plate raised. In addition, the insertion of the key 3 into the lock and the insertion of a coin 61 into the coin inlet 42 cannot be carried out during the overtime fee charging operation, as was described above. That is, during this period the coin inlet 42 is kept closed not only mechanically but also electrically.

As the drive cam 32 rotates, the armature 37*c* of the switch 37, as in FIG. 4(A), rides on the projection 38 of the drives cam 32 and is therefore tripped to the contant *a*. As a result, the NAND circuit 52 loses one "H" input signal, and therefore the motor M stops. Thus, the stepping drive means 35 has completed the overtime fee charging operating. This overtime fee charging operation is carried out whenever the predetermined unitary time has passed, and is accomplished within a short time, for instance, two seconds.

Figure 4B:
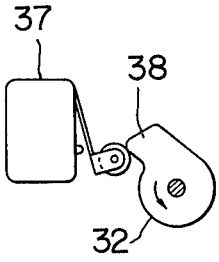

Thereafter, when the output of the inverter circuit 50 becomes an "L" signal, all of the inputs of the NAND circuit 51 receive "H" signals, and therefore, as was described before, the motor 36 is rotated. However, when the drive cam 32 is turned to the state shown in FIG. 4(B), the motor is stopped.

In the case when the user comes back to the locker within the unitary time to take out his baggage, the rental fee setting plate 17 has not been raised yet. Therefore, if he turns the key to open the lock 1 without inserting an additional coin, the locking lever 63 is disengaged from a slot (not shown) provided in the door, thus opening the door of the locker.

In the case when the user is going to open the door after the predetermined unitary time has passed, he has to follow the following steps.

He inserts the key 3 into the lock 1. Upon insertion of the key 3, the cam plate 4 is displaced in the direction of this key insertion, and the shutter lever 6 is turned to open the coin inlet (42).

Then, a coin is additionally inserted into the coin inlet 42. The coin, striking the ratchet lever 13, causes the rental fee setting plate 17 to fall a distance corresponding to one tooth thereof. When the necessary number of coins corresponding to the overtime fee have been inserted, the rental fee setting plate 17 operates to turn the engaging lever 22 clockwise so that the engaging lever 22 is disengaged from the engaging plate 23. Therefore, now it is possible for him to turn the key 3 to open the door.

On the other hand, upon insertion of the key 3, the armature of the key insertion detecting switch 5 is tripped over to the contact *a*. As a result, the count circuit 46 receives an "L" signal as a stop signal thereby to suspend the time counting operation. When the user turns the key 3 inserted in the lock 1 to unlock the locker, the armature of the key turn detecting switch 41 is tripped over to the contact *a*. As a result, the count circuit 46 is reset by a reset signal at an "L" level from the switch 41. This "L" level signal is applied also to the NOR circuit 54, and therefore the motor M in the stepping operation drive means 35 is driven through the operations of the gate circuits 52 and 53. The driving force of the motor M raises the rental fee setting plate 17 a distance corresponding to one tooth thereof, that is, the plate 17 is set ready for the next use of the coin-operated locker. This operation is ceased when the projection 38 of the drive cam 32 is met with the armature 37*c* of the switch 37 as is shown in FIG. 4(A). Thus, the coin-operated locker becomes ready for the next use.

Briefly summarized, in the operation of the above-described example, the counting of rental time is started at the time when the key turned to lock the locker (in which a piece of baggage has been placed) is removed from the lock, and this rental time counting operation is suspended at the time when the key is inserted into the lock to take a piece of baggage out of the locker. Then, the time lapse detecting section 43 is reset at the time when the key thus inserted is turned to unlock the locker.

The rental time control system may be so designed that the rental time counting operation, that is, the operation of the time lapse detecting section 43 is started at the time when the key is turned, instead of the time when the key is pulled out, or at the time when the door is closed after a piece of baggage has been put in the locker. Furthermore, the system may be so designed that the time-lapse detecting section 43 is reset at the time when, after the unlocking operation has been carried out, the door is opened.

The count circuit 46 of the time lapse detecting section 43 may be substituted by a mechanical or electrical time piece.

In the above-described example, the insertion of a coin 61 is obstructed by the shutter plate 10; however, the mechanical arrangement of the locker may be so designed that a coin 61 in introduced into another coin path by the coin sorting device 8*a* or it is led into another coin path branched from the coin path 8.

If summarized, the merits of this invention are as follows:

(1) Since the time-lapse detecting section is made inoperative when the key is inserted into the lock, the difficulty that the overtime fee charging operation may be carried out because the unitary time is up during insertion of the key, can be prevented.

(2) The overtime fee charging operation is positively carried out because the time-lapse detecting section is reset at the time when the key inserted into the lock is turned for opening the door or unlocking the lock, instead of the time when the key is inserted into the lock.

We claim:

1. In a locker having a coin controlled key activated locking means for enabling the locker to be opened, closed and locked, a rental time control system comprising:

a start of use detecting means associated with the locker for detecting the start of the use of the locker;

a key insertion detecting means connected to the locking means for detecting the insertion and withdrawal of a key in the locking means;

a time lapse detecting means connected to said key insertion detecting means and said start of use detecting means for detecting the lapse of time from the detection of the start of the use of the locker, for producing a time lapse detection signal whenever a predetermined period of time passes and for suspending operation upon the detection of the insertion of a key;

a rental fee setting means connected to the locking means and said time lapse detecting means having a coin deposit detecting means for detecting the deposit of a coin, a locking inhibiting means connected to the locking means and said coin deposit detecting means for preventing the locking of the locking means until the deposit of an initial coin, a time lapse counting means connected to said time lapse detecting means for counting the number of time lapse detection signals produced by said time lapse detecting means and an unlocking inhibiting means connected to the locking means, said coin deposit detecting means and said time lapse counting means for preventing the unlocking of the locking means until the deposit of further coins corresponding to the number of time lapse detection signals couted, whereby said rental fee is set at the number of coins corresponding to the number of predetermined periods detected by said time lapse detecting means.

2. A rental time control system as claimed in claim 1 wherein said start of use detecting means is in common with said key insertion detecting means, and said start of use is detected for starting said time lapse detecting means in its time lapse detecting operation when said key insertion detecting means detects the withdrawal of a key.

3. A rental time control system as claimed in claim 1 further comprising:

an end of use detecting means associated with the locker for detecting the end of the use of the locker;

a reset means connected to said end of use detecting means and said time lapse detecting means for resetting said time lapse detecting means upon detection of the end of the use of the locker.

4. A rental time control system as claimed in claim 3 wherein said end of use detecting means comprises a key turning detecting means for detecting when key is turned to unlock the locker.

5. A rental time control system as claimed in claim 3, wherein said end of use detecting means comprises a door opening detecting means for detecting when the door of the locker is opened.

* * * * *